US005924144A

United States Patent [19]

Peterson

[11] Patent Number: 5,924,144

[45] Date of Patent: Jul. 20, 1999

[54] INFLATABLE SWIMMING POOL AND SUPPORTING SHELL

[75] Inventor: Leroy L. Peterson, Omaha, Nebr.

[73] Assignee: Sportsstuff, Inc., Omaha, Nebr.

[21] Appl. No.: 09/054,116

[22] Filed: Apr. 2, 1998

[51] Int. Cl.[6] ..... A47C 27/08

[52] U.S. Cl. ..... 4/488; 4/506; 4/503

[58] Field of Search ..... 4/488, 506, 513, 4/498, 499, 503, 588, 599, 600; 220/653; 441/40, 66

[56] References Cited

U.S. PATENT DOCUMENTS

| | | | |
|---|---|---|---|
| 2,876,467 | 3/1959 | Lund | 441/66 |
| 3,608,099 | 9/1971 | Wall | 4/503 |
| 3,631,544 | 1/1972 | Tytel | 4/506 |
| 4,000,749 | 1/1977 | Busco | 4/498 |
| 4,366,963 | 1/1983 | Reeves et al. | 441/40 |
| 4,535,490 | 8/1985 | Wright | 4/488 |
| 4,538,311 | 9/1985 | Hall et al. | 4/488 |
| 4,547,919 | 10/1985 | Wang | 4/588 |
| 4,756,032 | 7/1988 | Wang | 4/588 |
| 5,729,840 | 3/1998 | Wu | 4/588 |

FOREIGN PATENT DOCUMENTS

| | | | |
|---|---|---|---|
| 438622 | 12/1967 | Switzerland | 4/588 |

*Primary Examiner*—Charles R. Eloshway
*Attorney, Agent, or Firm*—Henderson & Sturm

[57] ABSTRACT

An inflatable swimming pool having a plurality of vertical interior supporting webs extending between and connecting the inner and outer vertical side walls of the pool. The side walls and connecting webs are fabricated from polyvinylchloride or similar materials. A supporting shell, preferably fabricated from a tough, durable synthetic fabric such as nylon, includes a top gusset, a side wall, a bottom gusset, and a reinforcing bottom wall for added strength. A safety cover, also fabricated from nylon, includes a number of hooks that attach to loops on the shell to secure the cover in position when the pool is not in use.

19 Claims, 1 Drawing Sheet

INFLATABLE SWIMMING POOL AND SUPPORTING SHELL

BACKGROUND OF THE INVENTION

1. Field of the Invention

The present invention relates to the field of inflatable swimming pools, and more particularly to an inflatable swimming pool and supporting shell for enclosing an inflatable swimming pool for improved strength, puncture resistance, and durability.

2. Description of Related Art

Inflatable swimming pools are well known in the art and generally comprise an inflatable ring with a flooring sealed to the ring around its lower edge and typically fabricated from various plastics, such as polyvinylchloride (PVC). With the increasing costs of in-ground concrete swimming pools, however, larger above-ground pools with increased depth have become more popular. Inflatable pools, however, have heretofore been unsuitable with the increased depth due to the tremendous increase in water pressure on the sides of the pool which causes the walls to deform and tear. This has lead to above-ground pools with wooden or metal superstructures generally supporting a plastic liner which is more expensive and more difficult to assemble, disassemble and store.

Those concerned with these and other problems recognize the need for an improved inflatable swimming pool.

BRIEF SUMMARY OF THE INVENTION

The present invention discloses an inflatable swimming pool having a plurality of vertical interior supporting webs extending between and connecting the inner and outer vertical side walls of the pool. The side walls and connecting webs are fabricated from polyvinylchloride or similar materials. A supporting shell, preferably fabricated from a tough, durable synthetic fabric such as nylon, includes a top gusset, a side wall, a bottom gusset, and a reinforcing bottom wall for added strength. A safety cover, also fabricated from nylon, includes a number of hooks that attach to loops on the shell to secure the cover in position when the pool is not in use.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
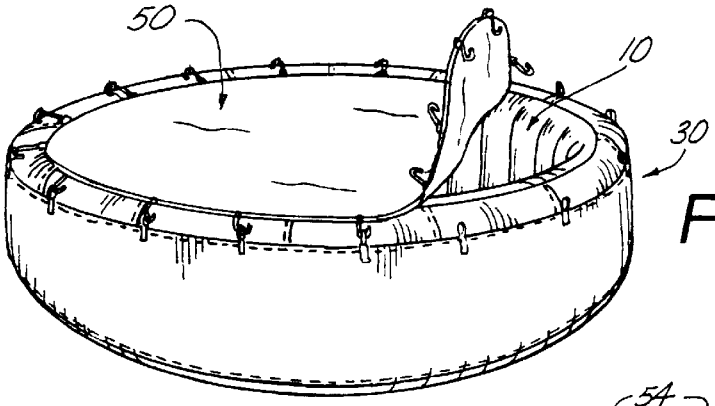
FIG. 1 is a perspective view of the inflatable pool and supporting shell with the safety cover in the process of being fully secured to the shell.

As can be seen by reference to the drawings, and in particularly to FIG. 1, that forms the basis of the present invention is designated generally by the reference number

10. FIG. 1 shows the inflatable swimming pool 10 received in the supporting shell 30, with the safety cover 50 partially secured to the shell 30.

Figure 4:
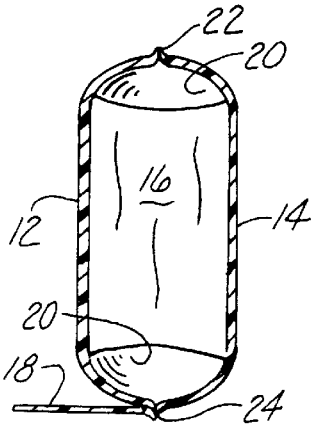
FIG. 4 is a sectional view taken along line 4—4 of FIG. 2.
Figure 2:
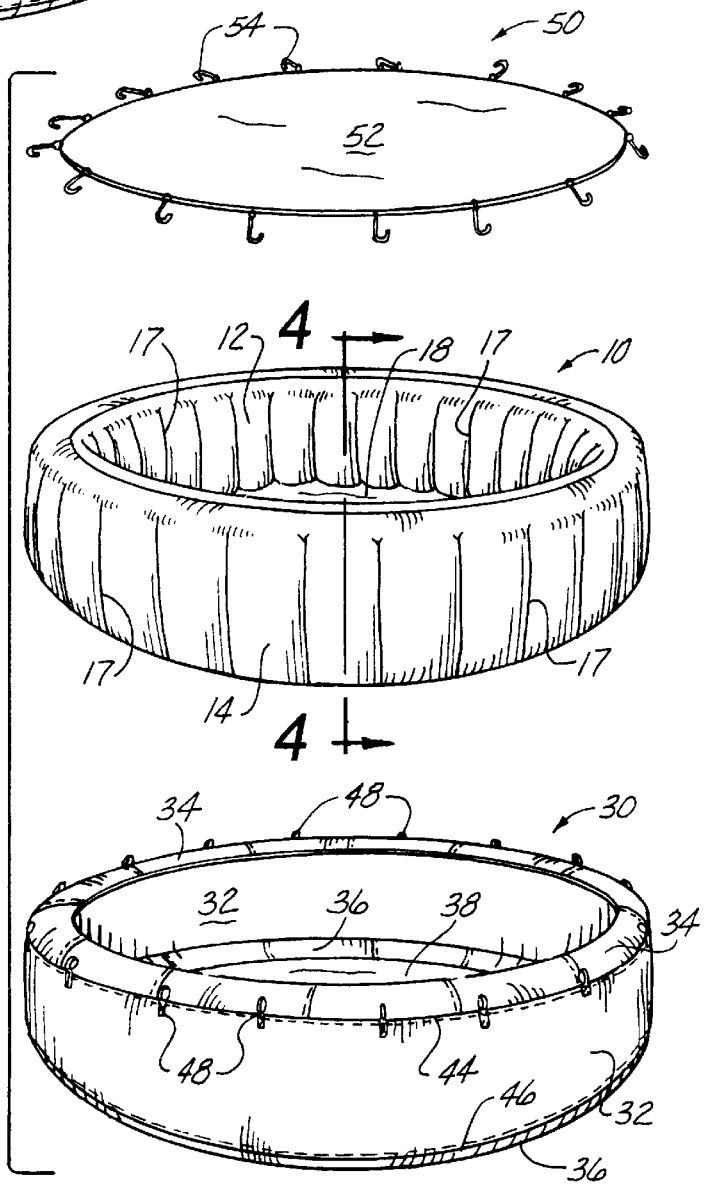
FIG. 2 is an exploded perspective view showing the shell, the pool, and the cover in their relative assembled positions.

As best shown in FIGS. 2 and 4, the swimming pool 10 is formed of polyvinylchloride (PVC) material including an inner vertical side wall 12, an outer vertical side wall 14, a plurality of interconnecting vertical support webs 16, and a floor 18, all being secured together by thermo-welding. The inner side wall 12 and the outer side wall 14 are formed of concentric rings of material attached at their top and bottom edges 22, 24. The vertical support web 16 extends radially between the inner and outer side walls 12, 14 at spaced intervals of approximately 15° to form a series of I-beam supports around the circumference of the interior annular cavity 20. The interior cavity 20 is defined by the spacing between the side walls 12, 14 when the pool 10 is inflated. Inflation of the pool 10 is done through an air valve (not shown) formed in one of the side walls 12, 14.

As illustrated in FIG. 4, the supporting webs 16 do not extend to the top and bottom edges 22, 24 so that air admitted through the air valve communicates with all points around the circumference of the annular cavity 20. As shown in FIG. 2, slight vertical indentations 17 in the exterior surface of the inner and outer side walls 12, 14 correspond to the location of the interior support webs 16. The support webs 16 forming the I-beam support columns provide increased strength to the inflated pool 10 so that water of greater depths can be supported within the pool 10 before the side walls 12, 14 deform.

Figure 3:
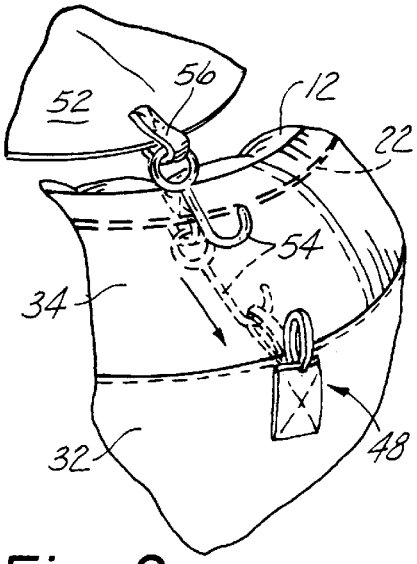
FIG. 3 is an enlarged partial perspective view illustrating the hook on the cover as it engages the loop on the shell.

The protective shell 30, as best shown in FIGS. 2 and 3, includes a side wall 32, top and bottom gussets 34, 36, and a bottom 38. The shell 30 is preferably made of durable fabric such as nylon, polyester, or Dacron. The side wall 32, the gussets 34, 36, and the bottom 38 may, for example, be made of 840D, 420D, and 210D nylon, respectively. Acceptable nylon fabrics may range from approximately 210D to approximately 1000D. The side wall 32 is formed of a ring of material with one or more vertical sewn seams. The top and bottom gussets 34, 36 are sewn to the top and bottom edges 44, 46, respectively, of the side wall 32. The top and bottom gussets 34, 36 are formed of a number of inwardly directed wedge-shaped segments sewn together at their adjacent edges. The bottom 38 is sewn to the inner edge of the bottom gusset 36. A series of loops 48 are sewn at spaced intervals around the side wall 32 near its top edge 44.

The safety cover 50 is also made of a suitable fabric such as nylon. The cover 50 includes a flat circular sheet 52 having a number of hooks 54 at spaced intervals. The sheet 52 is sized to slightly extend over the inner edge of the top gusset 34. As shown in FIG. 3, each hook 54 is attached to the sheet 52 by an elastic connector 56. When the cover 50 is in position, the hooks 54 on the edge of the sheet 52 engage corresponding loops 48 on the shell 30 to secure the cover in position.

To assemble, the pool 10 is first partially inflated. It is then placed within the shell 30 and fully inflated to provide a tight fit between the pool 10 and the shell 30. The pool 10 is then filled with water to the desired depth. The supporting webs 16 of the pool 10 provide support for the water as discussed above. Also, the supporting shell 30 provides further support to allow for water at even greater depths. The safety cover 50 is secured in position when the pool 10 is not in use.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An inflatable swimming pool, comprising:

an inner side wall formed by a inner ring of flexible material, the inner side wall having an upper edge and a lower edge;

an outer side wall formed by an outer ring of flexible material disposed out from and concentric to the inner ring, the outer side wall having an upper edge and a lower edge, the respective upper and lower edges of the inner and outer rings being secured to each other to form a closed annular cavity and a central open area;

a plurality of radially directed vertical support webs disposed within the annular cavity and attached to and interconnecting the inner side wall and the outer side wall;

a floor attached near the lower edges of the inner and outer side walls, the floor being disposed to extend over a lower end of the central open area to form an open top container for receiving water; and a supporting shell formed by a ring of flexible material having a top and bottom edge, a top gusset section attached to the top edge of the ring and disposed to extend radially inward, and a bottom gusset section attached to the bottom edge of the ring and disposed to extend radially inward, the shell being disposed to matingly receive and support the closed annular cavity when the cavity is fully inflated by a pressurized fluid.

2. The inflatable swimming pool of claim 1 further including a bottom panel attached to the bottom gusset section and extending between opposing sides thereof.

3. The inflatable swimming pool of claim 2 further including a removable safety cover releasably attached to the shell.

4. The inflatable swimming pool of claim 3 wherein loops attached to the ring of the shell are engaged by hooks attached to the safety cover.

5. The inflatable swimming pool of claim 1 further including a removable safety cover releasably attached to the shell.

6. The inflatable swimming pool of claim 5 wherein loops attached to the ring of the shell are engaged by hooks attached to the safety cover.

7. The inflatable swimming pool of claim 1 wherein the support webs are spaced at about 15° intervals around the annular cavity.

8. The inflatable swimming pool of claim 1 wherein the support webs are disposed below the upper edge of the inner and outer rings.

9. The inflatable swimming pool of claim 8 wherein the support webs are disposed above the lower edge of the inner and outer rings.

10. The inflatable swimming pool of claim 1 wherein the support webs are disposed above the lower edge of the inner and outer rings.

11. An inflatable swimming pool, comprising:

an inflatable ring having a lower edge;

a floor sealingly attached to the lower edge of the inflatable ring, to form an open top container for receiving water; and a supporting shell formed by a ring of flexible material having a top and bottom edge, a top gusset section attached to the top edge of the ring and disposed to extend radially inward, and a bottom gusset section attached to the bottom edge of the ring and disposed to extend radially inward, the shell being disposed to matingly receive and support the inflatable ring when it is fully inflated by a pressurized fluid, the supporting shell further including a bottom panel attached to the bottom gusset section and extending between opposing sides thereof to form a fully closed bottom.

12. The inflatable swimming pool of claim 11 wherein the bottom panel is formed of a durable fabric.

13. The inflatable swimming pool of claim 12 wherein the durable fabric is nylon.

14. The inflatable swimming pool of claim 12 wherein the bottom panel is sewn to the bottom gusset.

15. The inflatable swimming pool of claim 11 further including a removable safety cover releasably attached to the shell.

16. The inflatable swimming pool of claim 15 wherein loops attached to the shell are engaged by hooks attached to the safety cover.

17. The inflatable swimming pool of claim 16 wherein an elastic connector interconnects the hooks and the safety cover.

18. The inflatable swimming pool of claim 16 wherein the loops are attached to the shell adjacent the top edge of the ring.

19. The inflatable swimming pool of claim 18 wherein an elastic connector interconnects the hooks and the safety cover.

* * * * *